US006818571B1

(12) United States Patent
Pintz et al.

(10) Patent No.: US 6,818,571 B1
(45) Date of Patent: Nov. 16, 2004

(54) MESH FABRIC

(75) Inventors: Heiko Pintz, Nordhorn (DE); Hermann Bült, Gescher (DE)

(73) Assignee: Huesker Synthetic GmbH, Gescher (DE)

( * ) Notice: Subject to any disclaimer, the term of this patent is extended or adjusted under 35 U.S.C. 154(b) by 176 days.

(21) Appl. No.: 10/149,424

(22) PCT Filed: Oct. 24, 2000

(86) PCT No.: PCT/EP00/10451

§ 371 (c)(1),
(2), (4) Date: Aug. 15, 2002

(87) PCT Pub. No.: WO01/46504

PCT Pub. Date: Jun. 28, 2001

(30) Foreign Application Priority Data

Dec. 22, 1999 (DE) ..... 199 62 441

(51) Int. Cl.[7] ..... D03D 13/00; B32B 27/04; D03C 7/00

(52) U.S. Cl. ..... 442/2; 442/43; 442/203; 139/50; 139/51

(58) Field of Search ..... 442/1–58, 203–220; 139/50, 51

(56) References Cited

U.S. PATENT DOCUMENTS 5,965,467 A * 10/1999 Stevenson et al. ..... 442/218

FOREIGN PATENT DOCUMENTS

| | | |
|---|---|---|
| DE | 2000937 | 6/1978 |
| DE | 2816769 | 10/1979 |
| DE | 3120661 | 8/1986 |
| DE | 4123055 | 1/1993 |
| DE | 3136026 | 1/1994 |
| DE | 19530541 | 2/1997 |
| DE | 19803168 | 7/1999 |
| FR | 2076016 | 10/1971 |
| WO | 96/35833 | 11/1996 |

* cited by examiner

*Primary Examiner*—Ula C. Ruddock
(74) *Attorney, Agent, or Firm*—Greenblum & Bernstein, P.L.C.

(57) ABSTRACT

The invention relatrs to a wide-meshed fabric (1) treated with bonding agents. The inventive mesh is made up of bundles (4) consisting of several warop threads (3) and bundloes (6) consisting of several weft threads (5) surrounding the inner meshes (7). The warp threads (3) are interwoven with the weft threads (5) at intersection points (5) of the bundles (4) of warp threads and bundles (6) of weft threads (5) running at right-angles to each other. In order to firmly secure the warp threads and the weft threads, the bundles (4) of warp threads are divided into a first group (4') of warp threads and a second group (4") of warp threads and the first group of warp threads crosses over the second group of warp threads threads belonging to the same bundle (4) of warp threads for each mesh (7) thereby forming a half-twist. Similarly, the warp threads (3) of both groups (4', 4") of warp threads are interwoven with the weft threads (5), running substantially parallel to each other. Mesh fabrics of the a<bove-mentioned kind can be used to reinforce ground surfaces, road surfaces, layers of mortar and the like, in addition to use in poultry farming and use as fishing nets.

7 Claims, 2 Drawing Sheets

MESH FABRIC

CROSS-REFERENCE TO RELATED APPLICATIONS

The present application is a U.S. National Stage of International Application No. PCT/EP00/10451 filed Oct. 24, 2000, and claims priority of German Patent Application No. 199 62 441.0 filed Dec. 22, 1999.

BACKGROUND OF THE INVENTION

1. Field of the Invention

The invention relates to a wide-mesh fabric treated with bonding agents, wherein warp thread bundles comprising a plurality of warp threads and weft thread bundles comprising a plurality of weft threads surround the open inner meshes, wherein at the intersections of the warp thread bundles and weft thread bundles which extend at a right angle to each other the warp threads are interwoven with the weft threads.

2. Discussion of Background Information

Mesh fabrics of that kind which are used in particular for reinforcing bitumen-bound road surfaces or for reinforcing cement- or gypsum-bound layers of mortar, plasters or the like or as geomeshes for reinforcing ground surfaces are known from German laid-open applications (DE-OS)Nos 20 00 937; 31 20 661; 31 36 026, 41 23 055 and U.S. Pat. No. 5,965,467. These meshes can also be used as fishing nets or as ground meshes for raising chickens.

The warp threads and the weft threads preferably comprise multifilament synthetic yarns of high tensile strength, in particular aramid, polyester or the like. It is also possible to use glass filament yarns.

Depending on the respective purpose of use involved, the bonding agent which encloses the warp thread bundle, the weft thread bundle and the intersections thereof and thereby fixes the mesh fabric and protects it from chemical and mechanical loadings can be a PVC plastisol, a latex dispersion or dispersions of bitumen, acrylates or suitable soft plastic materials or mixtures thereof.

Wide-mesh fabrics are very loose prior to impregnation or enclosure with a bonding agent so that the warp threads and the weft threads can be easily displaced unless particular steps are taken in that respect. Interweaving of the warp threads with the weft threads is not sufficient to achieve sufficient stability for the wide-mesh fabric. So that the warp threads of a warp thread bundle and also the weft threads of a weft thread bundle are held together, the known mesh fabrics provide that associated with each warp thread bundle is at least one thin doup thread which is passed in a zig-zag configuration over the parallel warp threads of a warp thread bundle and extends at the sides of the warp thread bundle under a respective weft thread bundle. These doup threads which can be in the form of a half-doup thread or a full-doup thread are only intended to perform the function of holding the warp threads of the warp thread bundle and the weft threads of the weft thread bundle together until the mesh fabric is impregnated and/or encased with a bonding agent.

U.S. Pat. No. 5,965,467 discloses mesh fabrics in which the mutually juxtaposed warp threads of a warp thread bundle are divided into two groups, more specifically the odd-numbered threads in one group and the even-numbered threads in another group, so that in each case a thread of the one group lies beside a thread of the other group. For each mesh the threads of such a pair of warp threads cross twice in the manner of a full doup thread. At the intersections of that mesh fabric each weft thread is passed through between all pairs of warp threads of the warp thread bundle so that at the intersections the warp threads are interwoven with the weft threads in a linen weave.

Although this known mesh fabric is highly expensive in terms of the weaving procedure, it does not provide that the warp threads of a warp thread bundle are held together. In addition, the numerous crossing of the weft threads with the warp threads at the intersections of the weft thread bundles with the warp thread bundles suffers from the disadvantage that the warp threads are wider because the weft threads of the two groups of the weft thread bundle are passed in opposite directions between the mutually juxtaposed warp threads. A further effect of this frequent crossing of the warp and weft threads is that the mesh fabric is more stretchable than without that mutual crossing.

SUMMARY OF THE INVENTION

The present invention provides a mesh fabric in which the fixing which is achieved by a weave procedure is stronger than in the known mesh fabrics and in which stronger intermeshing with the ground surface to be reinforced or the layer to be reinforced is achieved by the warp threads of the warp thread bundle being more closely held together. In accordance with the invention, the warp thread bundles are divided into a first (for example left) warp thread group of mutually juxtaposed warp threads and a second (for example right) warp thread group of mutually juxtaposed warp threads and the first warp thread group crosses over the second warp thread group of the same warp thread bundle for each mesh in the manner of a half-doup thread. The fact that a group of warp threads of a warp thread bundle crosses the other group of said bundle for each mesh and the load-bearing warp threads are interwoven with the weft threads in closely mutually juxtaposed relationship produces a very stable mesh fabric in which neither the warp threads nor the weft threads can be displaced. At the intersections the warp threads of both warp thread groups extend in mutually parallel relationship. There is no need for an additional doup thread for stabilization purposes. This configuration further provides that the thickness of the warp thread bundles is twice as thick as the warp threads and—viewed in plan—the warp thread bundles are on average about 50% narrower than in the case of warp threads which extend parallel. That property and the fact that the warp thread bundles and weft thread bundles are held together more firmly at the intersections provides in the case of geomeshes better intermeshing with the ground layers to be stabilized or reinforced. Because the internal cross-section of the meshes is also increased the separation effect which is unwanted particularly in the case of geomeshes is reduced.

In a preferred embodiment of the invention weaving at the intersections of the warp thread bundles to the weft thread bundles is effected in such a way that a first group of the weft threads of a weft thread bundle extends over the warp threads of the first warp thread group and under the warp threads of the second warp thread group and a second group of the weft threads of a weft thread bundle extends under the warp threads of the first warp thread group and over the warp threads of the second warp thread group. In that respect it is desirable that, of the mutually juxtaposed weft threads of a weft thread bundle, a weft thread extends alternately over a warp thread group and the respectively adjacent weft thread extends under said warp thread group.

The present invention is directed to a wide-mesh fabric treated with bonding agents that includes warp thread bundles composed of a plurality of warp threads and weft thread bundles composed of a plurality of weft threads. The warp thread bundles include a first warp thread group and a second warp thread group, and the warp thread bundles and the weft thread bundles are arranged to form internal meshes with intersections in which the warp thread bundles and weft thread bundles are arranged to extend at right angles to each other and the warp threads are interwoven with the weft threads. For each warp thread bundle, the first warp thread group is arranged to cross the second warp thread group for each mesh.

In accordance with a feature of the present invention, for each warp thread bundle, the first warp thread group is arranged to cross over the second warp thread group for each mesh. Further, the first warp thread group crosses over the second thread group in the manner of a half-doup thread.

According to another feature of the invention, the warp thread bundles are composed of a plurality of mutually juxtaposed warp threads, the weft thread bundles are composed of a plurality of mutually juxtaposed weft threads, the first warp thread group is composed of a plurality of mutually juxtaposed warp threads, and the second warp thread group is composed of a plurality of mutually juxtaposed warp threads.

Moreover, the weft thread bundle includes a first weft thread group and a second weft thread group, and, in one of the intersections, threads of the first weft thread group are arranged to extend over the first warp thread group and under the second warp thread group and thread of the second weft thread group are arranged to extend under the first warp thread group and over the second warp thread group. Further, threads of the weft thread bundle are arranged side by side, and each odd-numbered weft thread of the weft thread bundle composes the first weft thread group and each even-numbered weft thread composes the second weft thread group.

The instant invention is directed to a wide-mesh fabric that includes warp thread bundles composed of a plurality of warp threads, in which the warp thread bundles include a first warp thread group and a second warp thread group, and weft thread bundles composed of a plurality of weft threads. The first and second warp thread groups and the weft thread bundles are arranged to form intersections and, between adjacent intersections, the first warp thread group is arranged to cross the second warp thread group.

According to a feature of the invention, between intersections, the first warp thread group is arranged to cross over the second warp thread group. Further, the first warp thread group crosses over the second thread group in the manner of a half-doup thread.

In accordance with another feature of the present invention, the weft thread bundles are composed of a plurality of weft threads arranged side by side each other, the first warp thread group is composed of a plurality of warp threads arranged side by side each other, and the second warp thread group is composed of a plurality of warp threads arranged side by side each other.

The weft thread bundles include a first weft thread group and a second weft thread group, and, in one of the intersections, threads of the first weft thread group are arranged to extend over the first warp thread group and under the second warp thread group and threads of the second weft thread group are arranged to extend under the first warp thread group and over the second warp thread group. Further, in an intersection adjacent the one intersection, the threads of the first weft thread group are arranged to extends under the first warp thread group and over the second warp thread group and the threads of the second weft thread group are arranged to extend over the first warp thread group and under the second warp thread group. Moreover, the threads of the weft thread bundle are arranged side by side each other, and the first weft thread group includes each odd-numbered weft thread and the second weft thread group includes each even-numbered weft thread. In the intersections, threads of the first and second warp thread groups are arranged at right angles to the threads of the first and second weft thread groups.

According to still another feature of the instant invention, in the intersections, threads of the first and second warp thread groups are arranged at right angles to threads of the weft thread bundles.

In accordance with still yet another feature of the present invention, in the intersections, threads of the first and second warp thread groups are arranged parallel each other.

BRIEF DESCRIPTION OF THE DRAWINGS

An embodiment of the invention is described in greater detail in the description hereinafter with reference to the drawings in which.

DETAILED DESCRIPTION OF THE INVENTION

Figure 1:
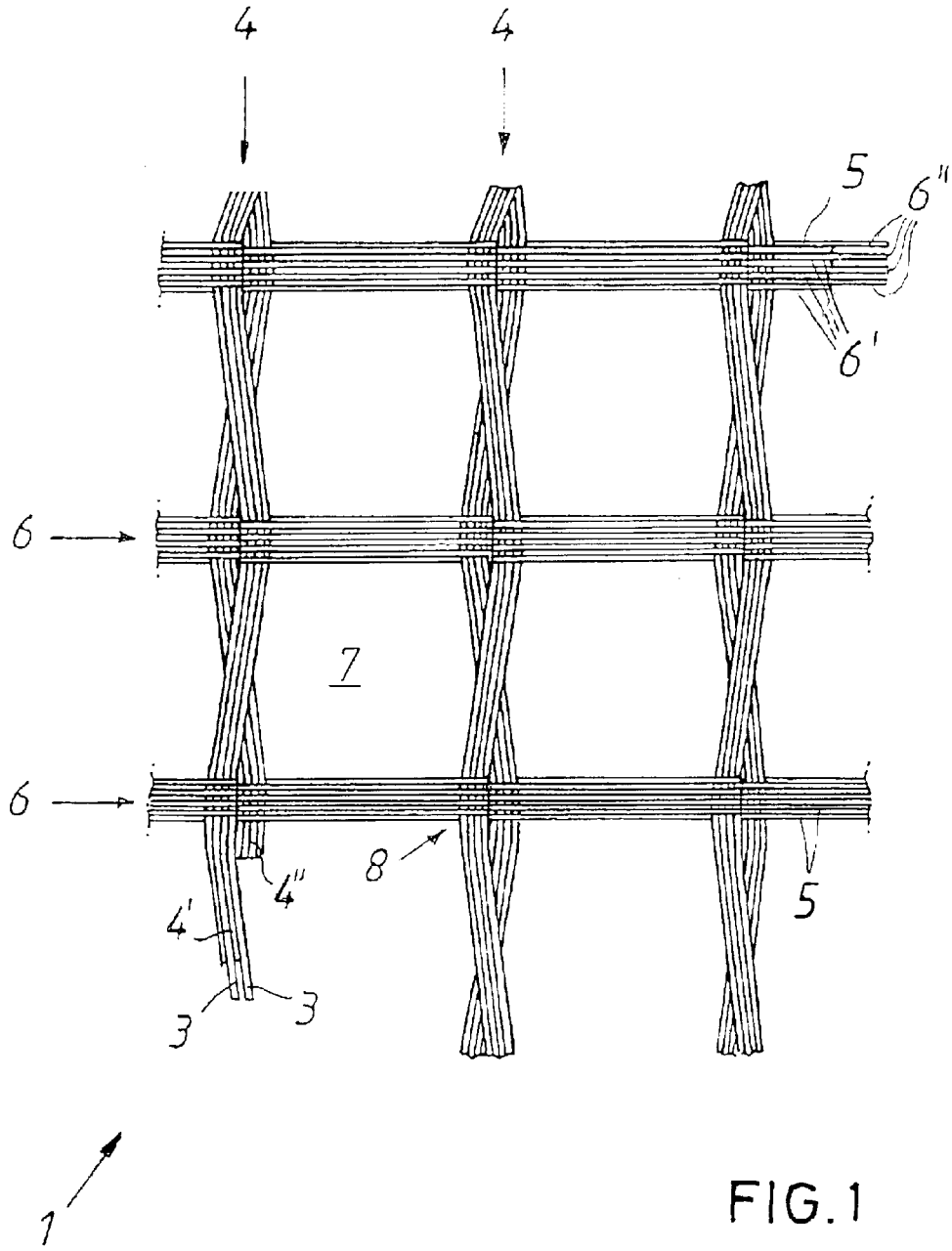
FIG. 1 shows a plan view of the mesh fabric according to the invention.

As FIG. 1 shows the mesh fabric is formed from warp thread bundles 4 which comprise for example eight warp threads 3 and weft thread bundles 6 which comprise eight weft threads 5. The weft thread bundles 6 and the warp thread bundles 4 each surround a respective internal mesh 7. The warp thread bundles 4 are divided into a first warp thread group 4' and a second warp thread group 4". Those two warp thread groups 4' and 4" are interwoven to the weft threads 5 of the weft thread bundles 6 at the intersections 8, extending in substantially mutually parallel relationship. Between two weft thread bundles 6, that is to say for each mesh 7, a warp thread group 4' respectively crosses over the other warp thread group 4" of a warp thread bundle 4.

In this embodiment the interweaving at the intersections 8 is effected in such a way that a first group 6' of the weft threads 5 of a weft thread bundle 6 extends over the warp threads 3 of the first warp thread group 4' and under the warp threads 3 of the second warp thread group 4" and a second group 6" of the weft threads 5 of a weft thread bundle 6 extends under the warp threads 3 of the first warp thread group 4' and over the warp threads 3 of the second warp thread group 4".

Figure 2:
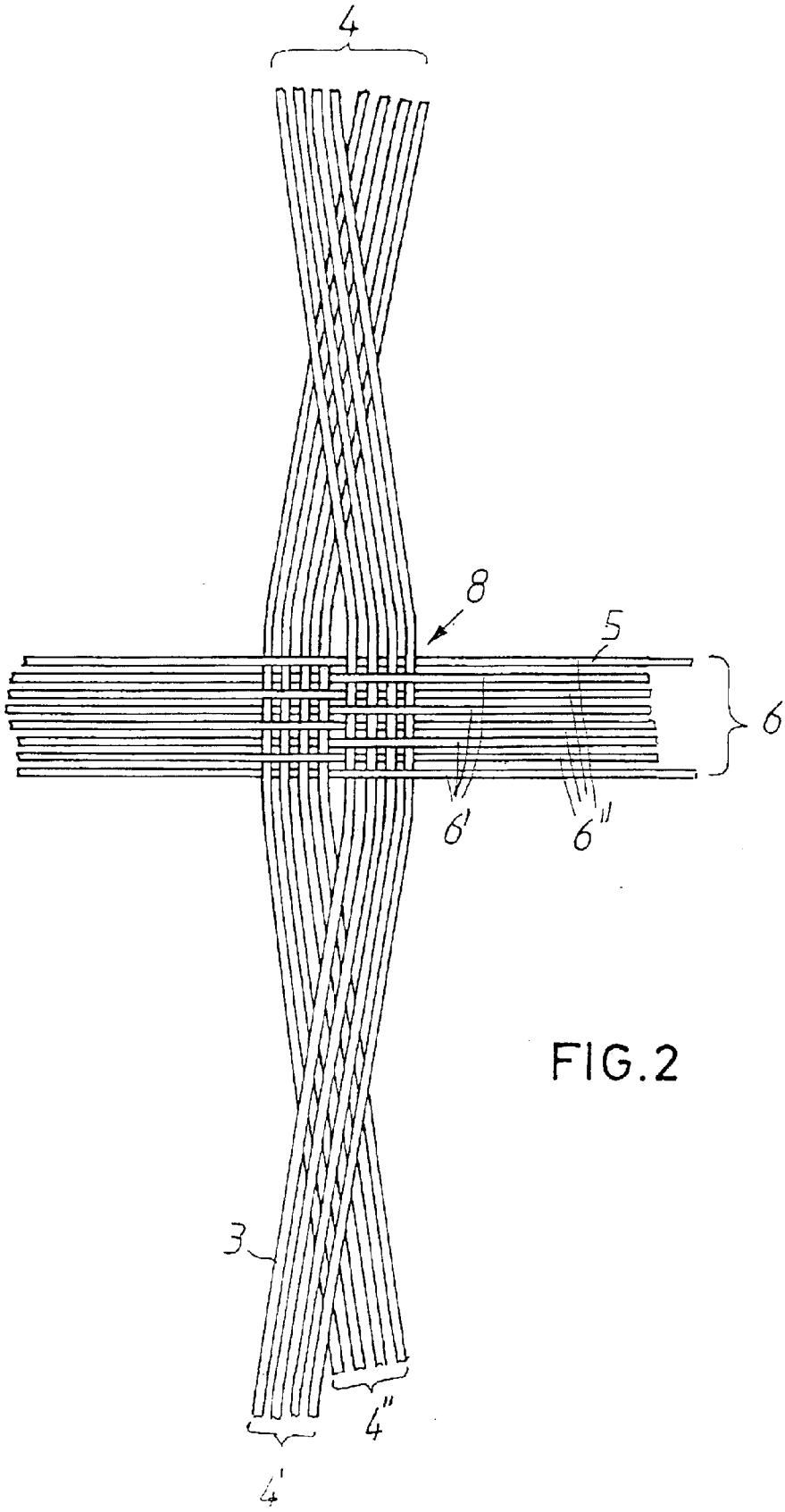
FIG. 2 is a view on an enlarged scale of the mutually crossing groups of a warp thread bundle and the intersection of the warp threads with the weft threads.

This kind of interweaving is particularly apparent from the enlarged view in FIG. 2. It can be seen therefrom that—counting from the bottom—each odd-numbered weft thread 5 extends over the first warp thread group 4' and then under the warp thread group 4" of the warp thread bundle 4 while each even-numbered weft thread 5 extends under the first warp thread group 4' and then over the second warp thread group 4" of the warp thread bundle.

List of References:

1 mesh fabric
3 warp threads

4 warp thread bundle
4' first warp thread group
4" second warp thread group
5 weft thread
6 weft thread bundle
6' first group
6" second group
7 internal mesh
8 intersection

What is claimed is:

1. A wide-mesh grid fabric treated with bonding agents, comprising:

warp thread bundles comprising a plurality of warp threads;

weft thread bundles comprising a plurality of weft threads, wherein said warp thread bundles and said weft thread bundles surround internal meshes of the grid fabric, and said plurality of warp threads of said warp thread bundles are divided into a first warp thread group and a second warp thread group, and essentially parallel warp threads of said first and second warp thread groups are interwoven with said weft threads at right angle intersections of said warp thread bundles and said weft thread bundles; and for each mesh, said first and second warp thread groups are arranged to cross over each other between two weft thread bundles in the manner of a half-doup thread.

2. The wide-mesh grid fabric in accordance with claim 1, wherein a first group of said plurality of weft threads of one of said weft thread bundles extends over the warp threads of said first warp thread group and under the warp threads of said second warp thread group and a second group of said plurality of weft threads of said one weft thread bundle extends under the warp threads of said first warp thread group and over the warp threads of said second warp thread group.

3. The wide-mesh grid fabric in accordance with claim 2, wherein each odd-numbered weft thread of said one weft thread bundle belongs to said first group of said weft threads and each even-numbered weft thread of said one weft thread bundle belongs to said second group of the weft threads.

4. A wide-mesh grid fabric treated with bonding agents, comprising:

warp thread bundles comprising a plurality of warp threads;

weft thread bundles comprising a plurality of weft threads, wherein said warp thread bundles and said weft thread bundles surround internal meshes of the grid fabric, and said plurality of warp threads of said warp thread bundles are divided into a first warp thread group and a second warp thread group, and essentially parallel warp threads of said first and second warp thread groups are interwoven with said weft threads at right angle intersections of said warp thread bundles and said weft thread bundles; and said first and second warp thread groups, which are composed of mutually juxtaposed warp threads, are arranged, for each mesh, to cross over each other between two weft thread bundles in the manner of a half-doup thread.

5. The wide-mesh grid fabric in accordance with claim 4, wherein a first group of said plurality of weft threads of one of said weft thread bundles extends over the warp threads of said first warp thread group and under the warp threads of said second warp thread group and a second group of said plurality of weft threads of said one weft thread bundle extends under the warp threads of said first warp thread group and over the warp threads of said second warp thread group.

6. The wide-mesh grid fabric in accordance with claim 5, wherein each odd-numbered weft thread of said one weft thread bundle belongs to said first group of said weft threads and each even-numbered weft thread of said one weft thread bundle belongs to said second group of the weft threads.

7. A wide-mesh grid fabric treated with bonding agents, comprising:

warp thread bundles comprising a plurality of warp threads divided into first and second warp thread groups;

weft thread bundles comprising a plurality of weft threads, said warp thread bundles and said weft thread bundles being arranged to form internal meshes;

said plurality of warp threads of said first and second warp thread groups are interwoven with said weft threads at intersections of said warp thread bundles and said weft thread bundles; and said first and second warp thread groups, for each mesh, are arranged to cross over each other in the manner of a half-doup thread.

* * * * *